United States Patent [19]

Courvoisier

[11] 4,116,395

[45] Sep. 26, 1978

[54] DOFFING DEVICE FOR SPINNING MACHINES

[75] Inventor: Guy Courvoisier, Geneva, Switzerland

[73] Assignee: Nuova San Giorgio S.p.A., Genova-Sestri, Italy

[21] Appl. No.: 754,606

[22] Filed: Dec. 27, 1976

[30] Foreign Application Priority Data

Jan. 8, 1976 [CH] Switzerland ..... 155/76

[51] Int. Cl.[2] ..... B65H 54/26

[52] U.S. Cl. ..... 242/35.5 A; 57/34 R; 242/18 DD; 242/19

[58] Field of Search ..... 242/35.5 A, 35.5 R, 242/18 R, 18 DD, 1 Q, 18 A; 57/52, 53, 34 R

[56] References Cited

U.S. PATENT DOCUMENTS

| | | | |
|---|---|---|---|
| 3,682,403 | 8/1972 | Willis | 242/18 A |
| 3,791,126 | 2/1974 | Kose et al. | 242/35.5 A UX |
| 3,801,030 | 4/1974 | Kobatake et al. | 242/35.5 A X |
| 3,820,730 | 6/1974 | Endo et al. | 242/35.5 R |
| 3,915,398 | 10/1975 | Corl | 242/35.5 A |
| 3,948,452 | 4/1976 | Burysek et al. | 242/35.5 A |
| 3,971,520 | 7/1976 | Shimai | 242/35.5 A |
| 4,007,882 | 2/1977 | Isoard | 242/35.5 A X |

*Primary Examiner*—Stanley N. Gilreath

[57] ABSTRACT

A device for bobbin doffing on a spinning frame. The device comprises a conduit connected to a suction source and means for replacing the bobbin with a yarn winding tube. This suction conduit is carried to move its suction inlet between a first position adjacent the yarn length stretched between a spinning unit and the bobbin, and a second position at which a pusher brings the yarn in contact with the surface of said winding tube.

The invention is particularly suitable for use on open end spinning frames.

3 Claims, 5 Drawing Figures

DOFFING DEVICE FOR SPINNING MACHINES

BACKGROUND OF THE INVENTION

Spinning machines, particularly those of the type referred to as open end spinning machines, are generally provided with a central belt conveyor intended to receive the doffed bobbins and then discharge the same from the machine. Available also are devices for automatically replacing a bobbin on the bobbin carriers with a tube on which the yarn is to be wound up.

If doffing and winding tube insertion operations do not give rise to particular problems, this is not true for yarn coupling or attachment to the winding tube. Additionally, since the spinning unit continues to produce yarn during doffing operation, this requires removal of the amount of yarn produced during such an operation, which entails the necessity of cutting the yarn a first time when the bobbin has to be doffed to clear it of the yarn being produced and a second time to remove the yarn produced during bobbin doffing.

Yarn attachment or coupling to the winding tube involves problems of reliability when taking into account the very high speed at which the tube may be driven by the driving cylinder. On one hand, the tube surface state should facilitate yarn attachment, while retaining a sufficient coefficient of friction between the driving cylinder and said tube. A lapped or ground tube surface does not assure per se any yarn attachment, so that it would be difficult to ensure winding or spooling start on a new tube with a good reliability, since reliability will decrease as output rate increases.

The yarn cutting problem introduces additional complications in the device. Furthermore, these cutting operations should be strictly synchronized.

SUMMARY OF THE INVENTION

It is the object of the present invention to improve reliability in a bobbin doffing device, while introducing substantial simplifications thereto.

To this end, the present invention is concerned with a device for doffing bobbins on a spinning machine, comprising a conduit connected to a suction source and the suction inlet or opening of which can be at a position adjacent a yarn length, stretched between the spinning unit and its winding bobbin in engagement with a driving cylinder, to draw or suck the yarn being produced by said spinning unit during bobbin doffing operation, means for removing this bobbin from its associated carrier, means for introducing a new winding tube on this carrier, means for attaching the yarn to the tube surface, and a member for cutting said yarn; this device is characterized by further comprising operating means for moving suction inlet of said conduit between said position adjacent the yarn length stretched between said spinning unit and its associated bobbin, and a second position; a pusher, the path of which intersects the path of the stretched yarn between the spinning unit and said suction inlet at its second position to deviate the yarn length and bring it to contact with a portion of the surface of the winding tube in engagement with said driving cylinder, the surface of said winding tube having a plurality of yarn attaching elements.

BRIEF DESCRIPTION OF THE DRAWING

The accompanying drawings schematically show by mere way of example an embodiment of a device according to the present invention.

In the drawings:

FIGS. 1*a* to 1*c* are sectional views of the unit 19 at three positions in the bobbin doffing process, corresponding, respectively, to the positions of FIG. 1, an intermediate position and FIG. 2;

DESCRIPTION OF A PREFERRED EMBODIMENT

Figure 1:
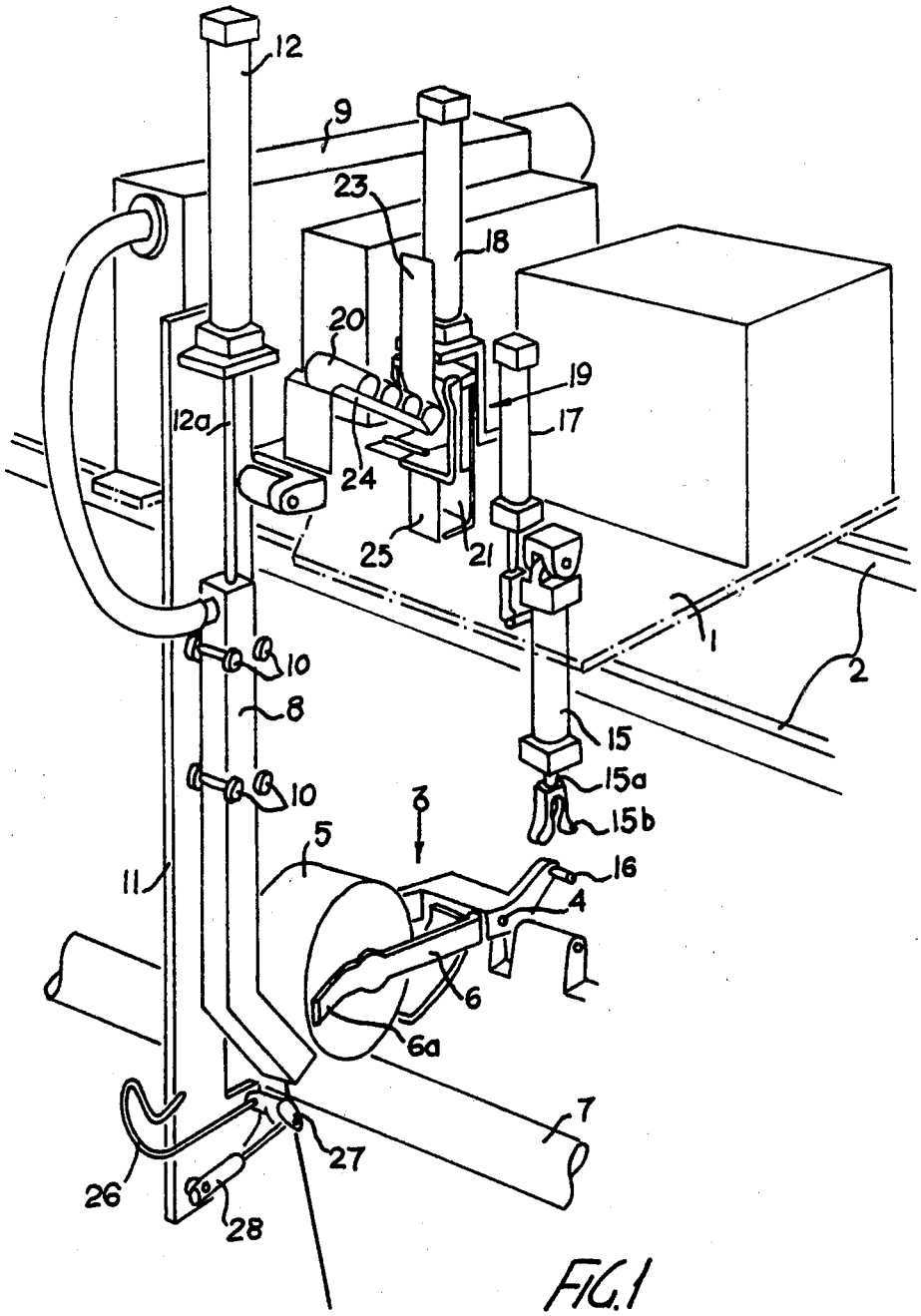
FIG. 1 is a perspective view of the device at one stage of the bobbin doffing process.
Figure 2:
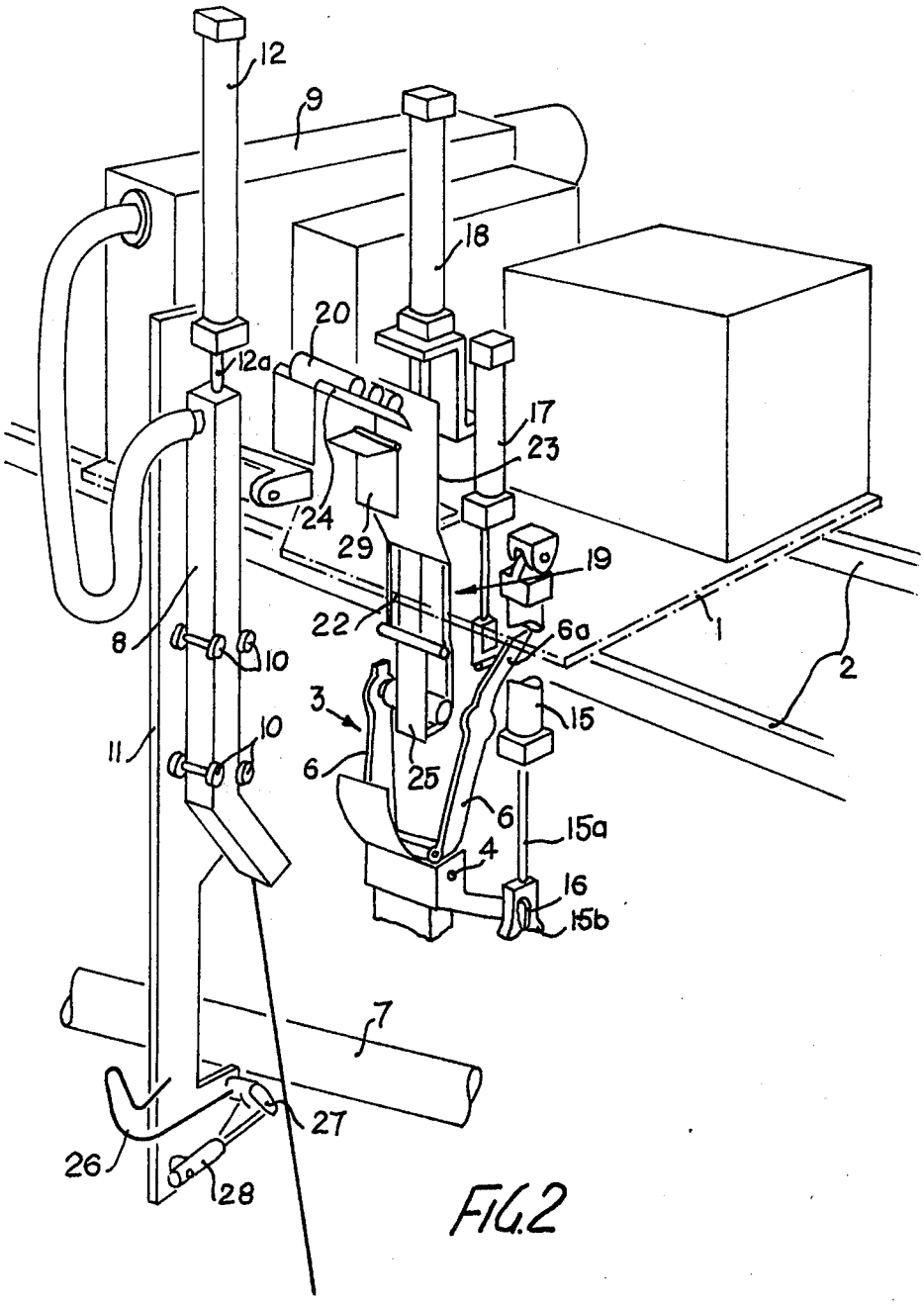
FIGS. 2 and 3 are perspective views of the device at certain stages of the bobbin doffing process.

The device shown in FIGS. 1 and 2 is mounted on a movable support 1, drawn in dashed lines, carried on guide rails 2 integral with the spinning machine frame (not shown). This frame also carries a bobbin support or carrier 3 in front of each spinning units (not shown) of the spinning machine. This carrier 3 is pivoted about a shaft 4 parallel to rails 2. Bobbin 5 is rotatably mounted between two resilient arms 6 and bears on a driving cylinder 7 which is common to all of the bobbins of the same row of spinning units.

The actual device comprises a suction conduit 8 which is connected to a fan 9. Said conduit 8 is mounted between four guide wheels or rollers 10 secured to a vertical plate 11 integral with said movable carrier or support 1. Stem 12*a* of jack 12 is attached to the upper end of conduit 8 to move the latter in vertical direction between said quide wheels or rollers 10.

Figure 4:
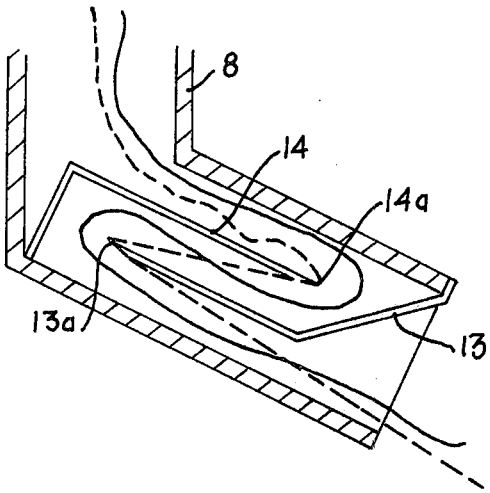
FIG. 4 is a sectional view showing a detail of the device.

A sectional view of the suction end of conduit 8 is illustrated in FIG. 4 to show its particular configuration. In this figure it will be seen that at this end a zigzag path has been formed by means of two partitions 13 and 14 providing a tortuous channel. The free transverse edges 13*a* and 14*a*, respectively, of each partition comprises a sharp corner. When being sucked by said fan 8, the yarn follows the tortuous channel, as shown by full lines. Should this yarn be held overcome the action of the suction force, the yarn would be tensioned and adhere against said edges 13*a* and 14*a*, cutting the same as shown by dashed lines.

A second jack 15 (FIGS. 1 and 2) is secured to said carrier 1. The stem 15*a* of this jack 15 terminates with pliers 15*b* comprising two resilient jaws joining at the ends thereof and providing a neck portion controlling the inlet of a fork. Said pliers are aligned with a peg 16 laterally extending to the outside of bobbin carrier 3.

A third jack 17 is secured to support member 1 and is intended, as will be seen from the following, to act upon end 6*a* of one of arms 6 forming an angle with said arm, inclining laterally of bobbin 5 for the purpose of moving said two arms 6 away from each other and freeing or clearing said bobbin The stem of a fourth jack 18, vertically mounted on support member 1, carries an unit 19 for the introduction of winding tubes 20. As best seen from FIGS. 1*a* to 1*c*, this unit comprises a cage 21, having an introduction slit or opening 22 and a separator 23. A tube magazine or loading means 24 is mounted on support member 1 with an unloading end adjacent said unit 19. The lower half of cage 21 is closed by a resilient thin plate 25. A tab 29 is pivoted to support member 1 and is normally maintained at horizontal position by resilient means (not shown) when said slit or opening 22 is in front of tube magazine or loader 24 (FIG. 1).

The above described device also comprises a yarn coupling mechanism, secured to vertical plate 11. Said mechanism comprises an arm 26 that is secured to a lever 27 laterally pivoted and on an axis at right angles to the plane of said vertical plate 11. Said lever 27 is connected by means of an articulated joint to the stem of a jack 28, the latter being intended for actuating lever 27 and rotating arm 26 to the position shown in FIG. 3. The free end of said arm 26 is of V-shaped outline for accomodating the yarn as it moves from the position shown in FIG. 2 to that shown in FIG. 3, and bringing the yarn in contact with the surface of winding tube 20.

Figure 5:
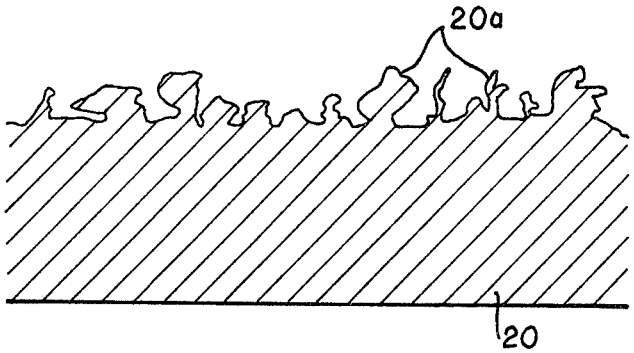
FIG. 5 is a sectional view as enlarged by twenty times showing the state of the surface of a yarn winding tube.

The surface of said tube 20 has a plurality of coupling protuberances 20*a* that in FIG. 5 are shown on enlarged scale in a ratio of 20:1. Said tube is made of plastics material, in this exemplary case polypropylene, and its surface is treated by sandblasting with jets of carborundum grits of a size in the range of 0.8–1.2 mm and under a pressure of 5–6 atmospheres.

The size of the so shaped protuberances is in the order of 0.4–0.5 mm. Owing to these protuberances, the yarn is immediately coupled or attached just as it contacts said surface, even if tube 20 is driven at a very high speed. On the other hand, said sandblasted surface 20*a* has also a sufficient coefficient of friction to bring the tube in contact with the rotating driving cylinder. Of course, the two characteristics that a surface 20*a* should exhibit, that is a yarn coupling capacity and sufficient coefficient of friction for frictional drive of tube 20, are contradictory, and this is a particular area of interest of the proposed solution. Thus, tests carried out with these tubes have provided quite satisfactory results, as to both yarn coupling and frictional operation of tube 20. Now, this coupling capacity of surface 20*a* of tube 20 is a substantial simplification in the concept of the described device over the prior art devices, wherein the yarn has to be inserted between the driving shaft 7 and tube 20, since only the yarn pinch between these two members enables dragging such a yarn. This coupling surface 20*a* also affords an increase not only in the reliability of spooling when winding up a new bobbin on the tube, but also in the rotational speed of this tube at the start of winding up.

The operation sequence of the bobbin loading device will now be described, starting from the stage shown in FIG. 1.

At the time when such a device has to change the bobbin, that is to doff a bobbin 5 to replace the same with a tube 20, the device is moved along guide rails 2 to a position in front of the spinning station, at which doffing is required. At this position, suction conduit 8 is adjacent to a portion of the yarn length entending from the spinning unit (not shown) to bobbin 5. Fan 9 is operated, causing a vacuum to be built up in conduit 8. Then, jack 15 causes a downward movement of its stem 15*a*, pliers 15*b* of which encounters said peg 16, whereby carrier 3 is rotated upwardly. When this peg 16 reaches the bottom location of its circular path about axis 4, stem 15*a* still continues its donward movement until the jaws of pliers 15*b* open and then close on each other to capture peg 16 within the fork provided between the jaws of pliers 15*b*, as shown in FIG. 2. During this rotation of carrier 3, the yarn produced by the spinning unit is sucked into conduit 8 and the yarn portion sucked into conduit 8 and joined to the bobbin is exposed to a traction stretching the yarn in the tortuous path provided at the suction end of conduit 8 by partitions 13 and 14, so that the yarn is brought to bear against sharp edges 13*a* and 14*a*, cutting the yarn and separating the yarn of bobbin 5 which is about to be doffed from the remaining yarn that continues to be sucked by fan 9. The fack 12 is then operated to move conduit 8 upwardly to the position shown in FIG. 2.

Then, jack 17 is operated, the latter lowering the stem to encounter end 6*a* and slides against said bent end moving the two arms 6 away from each other, thereby releasing bobbin 5 which is picked up by a belt conveyor (not shown). Said jack 17 remains at lowered position and then the fourth jack 18 is operated to lower the unit 19.

At its top position, unit 19 is at the position shown in FIG. 1, at which position introduction slit or opening 22 is in front of the unloading end of tube loading means 24. Tab 29 is at horizontal position, separator 23 is above tubes 20 carried by loading means 24, so that said tubes 20 will slide from the ramp of loading means 24 until the leading tube encounters the rear vertical wall of cage 21. While jack 18 lowers cage 21, separator 23 passes or moves between the tube that is first introduced into the cage and the tube adjacent thereto and blocks the path of those tubes 20 following that tube which is engaged in said cage 21. When said tube 20 engaged within the cage is urged downwardly by the lower end of the separator 23, tab 29 resiliently moves away and tube 20 falls into said cage 21. The cage stops at the height or level of the free ends of arms 6 of carrier 3 at doffing position for bobbin 5, just as shown in FIG. 2.

Figure 3:
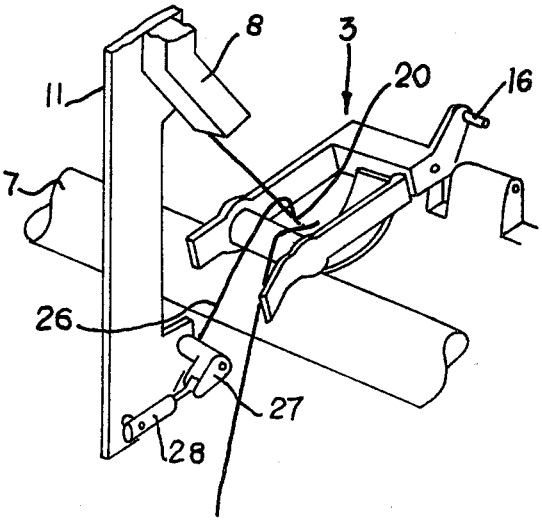

The stem of jack 17 is moved back to top position, so that said arm 6, which had been moved away to allow for removal of bobbin 5 and loading of tube 20, is now bearing against one end of tube 20 which is captured between said arms 6. Stem 15*a* of jack 15 moves upward again, in turn dragging said peg 16 and rotating carrier 3 towards cylinder 7 until tube 20 bears against cylinder 7 (FIG. 3). As carrier 3 starts to rotate towards cylinder 7, tube 20 captured between arms 6 is removed from cage 21 by flexing the resilient thin plate 25 (FIG. 1*c*). As soon as tube 20 encounters the driving cylinder, carrier 3 is stopped, and stem 15*a* continues to move upwardly and is separated from peg 16, which separates the jaws of pliers 15*b*. Tube 20 is then rotated by cylinder 7 which continuously revolves, and this because of being common to an entire row of bobbins.

Jack 28 retracts its stem, causing lever 27 and arm 26 to rotate to the position shown in FIG. 3. During its rotation, said arm 26 encounters the yarn sucked by conduit 8 and pulls it, bringing the latter against surface 20*a* of tube 20. Due to traction exerted on the yarn by the movement of arm 26 the yarn is stretched and cut between the edges 13*a* and 14*a* of partitions 13 and 14, forming the tortuous path located at the suction opening or inlet of conduit 8. The yarn portion that has been brought in contact with the surface of tube 20 is immediately gripped by coupling protuberances 20*a* (FIG. 5) and wound up about said tube.

Thus, the bobbin change cycle is terminated and the described device is moved to another spinning unit.

What is claimed is:

1. A bobbin doffing device for substituting a winding tube for a bobbin mounted on support means and rotated by a drive means for receiving yarn from a spinning unit, said doffing device comprising a suction conduit having a suction inlet, means for moving the suction inlet of said conduit from a first position adjacent a yarn length stretched between said spinning unit and said bobbin to allow said conduit to suck the yarn produced by said spinning unit, and a second position spaced from said first position for holding the yarn stretched between said spinning unit and said suction inlet, means for removing said bobbin from said drive means whereby the yarn is picked up by said suction inlet when moved to said first position, yarn cutting means for cutting the yarn extending from said suction inlet to said bobbin when said suction inlet is in said first position, means for removing said bobbin from said support means, means for mounting said winding tube on said support means, said winding tube having a yarn adhering surface, and a yarn pusher operatively related to said yarn cutting means to move yarn stretched between said spinning unit and said suction inlet into operative cutting relation to said yarn cutting means and into contact with said yarn adhering surface of said winding tube when said suction inlet is moved to said second position, whereby the yarn extending between said suction inlet and said spinning unit is cut and the cut yarn extending from said spinning unit is adhered to said winding tube for winding thereon.

2. A device as claimed in claim 1 wherein said yarn cutting means comprises partitions extending one over the other in said suction inlet of said conduit, said partitions defining a tortuous path for yarn and having transverse cutting edges.

3. A device as claimed in claim 1 wherein said yarn pusher comprises a rocking arm having a yarn guiding end, and means to rotate said rocking arm from a first position spaced from the yarn path to a second position adjacent said winding tube.

* * * * *